US010433073B2

(12) United States Patent
Ishii et al.

(10) Patent No.: US 10,433,073 B2
(45) Date of Patent: Oct. 1, 2019

(54) ELECTROACOUSTIC TRANSDUCER

(71) Applicant: TAIYO YUDEN CO., LTD., Chuo-ku, Tokyo (JP)

(72) Inventors: Shigeo Ishii, Takasaki (JP); Hiroshi Hamada, Takasaki (JP); Yutaka Doshida, Takasaki (JP); Takashi Tomita, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 0 days.

(21) Appl. No.: 16/044,339

(22) Filed: Jul. 24, 2018

(65) Prior Publication Data

US 2019/0037319 A1 Jan. 31, 2019

(30) Foreign Application Priority Data

Jul. 27, 2017 (JP) ..... 2017-145207

(51) Int. Cl.

| | |
|---|---|
| ***H04R 23/02*** | (2006.01) |
| ***H04R 17/00*** | (2006.01) |
| ***H04R 7/12*** | (2006.01) |
| ***H04R 9/06*** | (2006.01) |
| ***H04R 1/24*** | (2006.01) |
| ***H04R 29/00*** | (2006.01) |
| *H04R 3/14* | (2006.01) |
| *H04R 1/10* | (2006.01) |
| *H04R 31/00* | (2006.01) |

(52) U.S. Cl.

CPC ..... *H04R 23/02* (2013.01); *H04R 1/24* (2013.01); *H04R 7/12* (2013.01); *H04R 9/06* (2013.01); *H04R 17/00* (2013.01); *H04R 29/001* (2013.01); *H04R 1/1008* (2013.01); *H04R 1/1016* (2013.01); *H04R 3/14* (2013.01); *H04R 31/006* (2013.01)

(58) Field of Classification Search

CPC ..... H04R 23/02; H04R 17/00; H04R 9/06; H04R 7/12; H04R 3/14

USPC ..... 381/190, 96, 303, 98–99, 345, 184

See application file for complete search history.

(56) References Cited

U.S. PATENT DOCUMENTS 5,781,642 A * 7/1998 Tanaka ..... H04R 3/14 381/345

2016/0119719 A1* 4/2016 Doshida ..... H04R 1/1075 381/190

FOREIGN PATENT DOCUMENTS

| | | | |
|---|---|---|---|
| JP | S6268400 | U | 4/1987 |
| JP | 2013150305 | A | 8/2013 |
| JP | 5759641 | B1 | 8/2015 |
| JP | 2016086398 | A | 5/2016 |

* cited by examiner

*Primary Examiner* — Melur Ramakrishnaiah

(74) *Attorney, Agent, or Firm* — Law Office of Katsuhiro Arai

(57) ABSTRACT

An electroacoustic transducer includes a dynamic speaker that generates a first acoustic sound, and a piezoelectric speaker that generates a second acoustic sound. The sum of the sound pressures of the first and second acoustic sounds in a crossover frequency range of the sound pressure of the first acoustic sound and the sound pressure of the second acoustic sound, is adjusted to be equal to or greater than 0.5 times the sound pressure of the first acoustic sound in the crossover frequency range so as to improve the acoustic properties in the crossover frequency range.

13 Claims, 9 Drawing Sheets

ELECTROACOUSTIC TRANSDUCER

BACKGROUND

Field of the Invention

The present invention relates to an electroacoustic transducer comprising a dynamic speaker and a piezoelectric speaker.

Description of the Related Art

Piezoelectric sound-generating elements are widely used as simple means for electroacoustic conversion, frequently found in such applications as earphones, headphones, and other acoustic equipment, as well as speakers for mobile information terminals, etc., for example. A piezoelectric sound-generating element is typically constituted by a vibration plate with a piezoelectric element attached on one face or both faces thereof (refer to Patent Literature 1, for example).

On the other hand, Patent Literature 2 describes headphones comprising a dynamic driver and a piezoelectric driver, to allow for sound reproduction over a wide bandwidth through parallel driving of these two drivers. The piezoelectric driver is provided at the center part of the interior face of a front cover that closes the front face of the dynamic driver and functions as a vibration plate, and this piezoelectric driver is constituted so that it functions as a high-range driver.

Patent Literature 3 describes an electroacoustic transducer comprising a dynamic speaker and a piezoelectric speaker, using the dynamic speaker for the low range and the piezoelectric speaker for the high range. This electroacoustic transducer is constituted with passage parts in or around the piezoelectric speaker, so that the sound waves output from the piezoelectric speaker can be adjusted to desired frequency properties by optimizing the size and number of passage parts.

BACKGROUND ART LITERATURES

[Patent Literature 1] Japanese Patent Laid-open No. 2013-150305

[Patent Literature 2] Japanese Utility Model Laid-open No. Sho 62-68400

[Patent Literature 3] Japanese Patent No. 5759641

SUMMARY

There has been a demand for further improvement of sound quality in earphones, headphones, and other acoustic equipment in recent years. An electroacoustic transducer comprising a dynamic speaker and a piezoelectric speaker is subject to a phenomenon (dip) in which the sound pressure level of a composite sound composed of two reproduced sounds drops suddenly near a frequency at which the sound pressure level of a reproduced sound from the dynamic speaker intersects the sound pressure level of a reproduced sound from the piezoelectric speaker (this frequency is hereinafter also referred to as "crossover frequency").

In light of the aforementioned situation, an object of the present invention is to provide an electroacoustic transducer that can improve the acoustic properties near a crossover frequency.

Any discussion of problems and solutions involved in the related art has been included in this disclosure solely for the purposes of providing a context for the present invention, and should not be taken as an admission that any or all of the discussion were known at the time the invention was made.

To achieve the aforementioned object, the electroacoustic transducer pertaining to a mode of the present invention comprises a dynamic speaker that generates a first acoustic sound, and a piezoelectric speaker that generates a second acoustic sound.

The sum of the sound pressures of the first and second acoustic sounds in a crossover frequency range of the sound pressure of the first acoustic sound and the sound pressure of the second acoustic sound, is equal to or greater than 0.5 times the sound pressure of the first acoustic sound in the crossover frequency range.

According to the electroacoustic transducer, the sum of the sound pressures of the first and sound acoustic sounds in the crossover frequency range is equal to or greater than 0.5 times the sound pressure of the first acoustic sound in the crossover frequency range, and therefore any drop (dip) in the sound pressure level of the composite sound composed of the first and second acoustic sounds can be effectively reduced in the crossover frequency range.

The sum of the sound pressures of the first and second acoustic sounds in the crossover frequency range may be equal to or greater than one times the sound pressure of the first acoustic sound in the crossover frequency range.

The piezoelectric speaker may have a circular vibration plate. In this case, the diameter of the vibration plate is 10 mm or less.

According to the present invention, the acoustic properties near a crossover frequency can be improved.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

Figure 1:
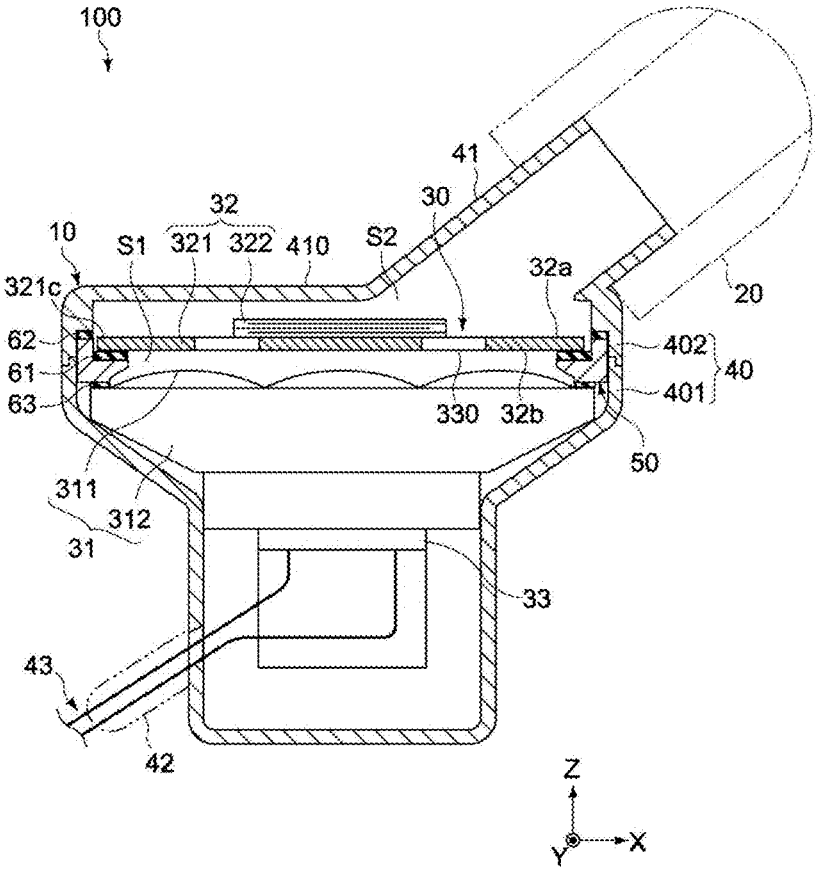
FIG. 1 is a schematic side cross-sectional view showing the constitution of the electroacoustic transducer pertaining to an embodiment of the present invention.

31—Dynamic speaker
32—Piezoelectric speaker
40—Housing
50—Support member
100—Earphone
321—Vibration plate
322—Piezoelectric element

DETAILED DESCRIPTION OF EMBODIMENTS

An embodiment of the present invention is explained below by referring to the drawings.

[Basic Constitution]

First, the basic constitution of the electroacoustic transducer in this embodiment is explained.

FIG. 1 is a schematic side cross-sectional view showing the constitution of an earphone 100 being the electroacoustic transducer pertaining to an embodiment of the present invention.

In the figure, the X-axis, Y-axis and Z-axis represent the three axis directions crossing at right angles with one another.

The earphone 100 has an earphone body 10 and an earpiece 20. The earpiece 20 is attached to a sound-guiding path 41 of the earphone body 10 and also constituted so that it can be worn in the user's ear.

The earphone body 10 has a sounding unit 30 and a housing 40 that encloses the sounding unit 30. The sounding unit 30 has a dynamic speaker 31 and a piezoelectric speaker 32.

(Housing)

The housing 40 has an internal space in which the sounding unit 30 is enclosed, and is constituted as a two-piece structure that can be separated in the Z-axis direction. Provided on one end face 410 (upper end face in the figure) of the housing 40 is a sound-guiding path 41 that guides the sound waves generated by the sounding unit 30 to the outside.

The housing 40 is constituted as a conjugate of a first housing part 401 and a second housing part 402. The first housing part 401 has a housing space in which the sounding body 30 is enclosed. The second housing part 402 has a sound-guiding path 41, and is combined with the first housing part 401 in the Z-axis direction to cover the piezoelectric speaker 32.

The internal space of the housing 40 is divided by the piezoelectric speaker 32 into a first space part S1 and a second space part S2. The dynamic speaker 31 is placed in the first space part S1. The second space part S2 is a space part that connects to the sound-guiding path 41, and is formed between the piezoelectric speaker 32 and the bottom part 410 of the second housing part 402. The first space part S1 and the second space part S2 connect to each other via a passage part 330 of the piezoelectric speaker 32.

(Dynamic Speaker)

The dynamic speaker 31 is constituted by a dynamic speaker unit that functions as a woofer for reproducing sound in the low range. In this embodiment, it is constituted by a dynamic speaker that primarily generates sound waves of 7 to 9 kHz or lower, and has a mechanism part 311 including a voice coil motor (electromagnetic coil) or other vibration body, and a pedestal part 312 that supports the mechanism part 311 in a vibratable manner.

Figure 2:
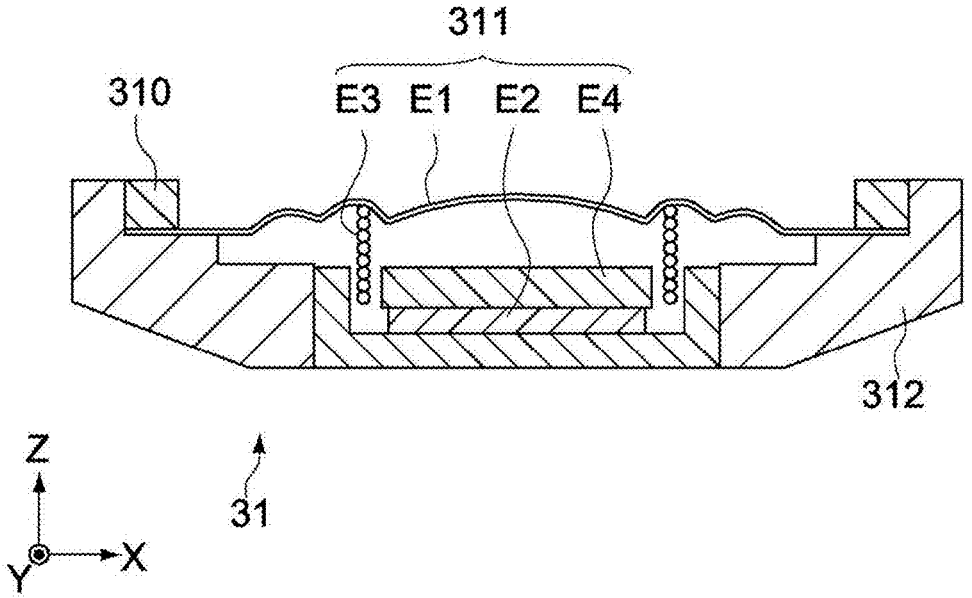
FIG. 2 is a cross-sectional view of key parts showing a constitutional example of the dynamic speaker in the electroacoustic transducer.

The constitution of the mechanism part 311 of the dynamic speaker 31 is not limited in any way. FIG. 2 is a cross-sectional view of key parts showing a constitutional example of the mechanism part 311. The mechanism part 311 has a vibration plate E1 (second vibration plate) supported on the pedestal part 312 in a vibratable manner, a permanent magnet E2, a voice coil E3, and a yoke E4 that supports the permanent magnet E2. The vibration plate E1 is supported on the pedestal part 312, with its peripheral part sandwiched between the bottom part of the pedestal part 312 and a ring-shaped fixture 310 integrally assembled thereto.

The voice coil E3 is formed by a conductive wire wrapped around a bobbin that serves as a winding core, and is joined to the center part of the vibration plate E1. Also, the voice coil E3 is placed vertically to the direction of the magnetic flux of the permanent magnet E2. When an alternating current (sound signal) flows through the voice coil E3, an electromagnetic force acts upon the voice coil E3 and thus the voice coil E3 vibrates in the Z-axis direction in the figure according to the signal waveform. This vibration is transferred to the vibration plate E1 coupled to the voice coil E3, to vibrate the air inside the first and second space parts S1, S2 (FIG. 1), thereby generating a sound wave in the aforementioned low range (first acoustic sound).

The dynamic speaker 31 is fixed inside the housing 40 by any method as deemed appropriate. Fixed to the top part of the dynamic speaker 31 is a circuit board 33 that constitutes the electrical circuit of the sounding unit 30. The circuit board 33 is electrically connected to a cable 43 that has been led in via a lead part 42 of the housing 40, and outputs electrical signals to the dynamic speaker 31, and also to the piezoelectric speaker 32, via wiring members that are not illustrated.

(Piezoelectric Speaker)

The piezoelectric speaker 32 constitutes a speaker unit that functions as a tweeter for reproducing sound in the high range. In this embodiment, its oscillation frequency is set so that sound waves of 7 to 9 kHz or higher are primarily generated. The piezoelectric speaker 32 has a vibration plate 321 (first vibration plate) and a piezoelectric element 322.

The vibration plate 321 is constituted by a metal (such as 42 alloy) or other conductive material, or resin (such as liquid crystal polymer) or other insulation material, and its planar shape is formed as an approximate circle. "Approximate circle" means not only a circle, but also virtually circular shapes as described below. The outer diameter and thickness of the vibration plate 321 are not limited and may be set in any way as deemed appropriate according to the size of the housing 40, the frequency range of reproduced sound waves, etc. In this embodiment, a vibration plate of approx. 8 to 12 mm in diameter and approx. 0.2 mm in thickness is used.

The vibration plate 321 may, as necessary, have cutout parts that are shaped as, for example, recesses concaving or slits cut from its outer periphery to inner periphery side. It should be noted that the planar shape of the vibration plate 321 is considered virtually a circle, so long as its approximate shape is a circle, even when it is not strictly a circle as a result of formation of the aforementioned cutout parts, etc.

The vibration plate 321 has a first principal face 32*a* that faces the sound-guiding path 41 and a second principal face 32*b* that faces the dynamic speaker 31. In this embodiment, the piezoelectric speaker 32 has a unimorph structure characterized by the piezoelectric element 322 joined only to the first principal face 32*a* of the vibration plate 321.

It should be noted that, instead of being limited to the foregoing, the piezoelectric element 322 may also be joined to the second principal face 32*b* of the vibration plate 321. In addition, the piezoelectric speaker 32 may also be constituted as a bimorph structure characterized by piezoelectric elements joined to the two principal faces 32*a*, 32*b* of the vibration plate 321, respectively.

Figure 3:
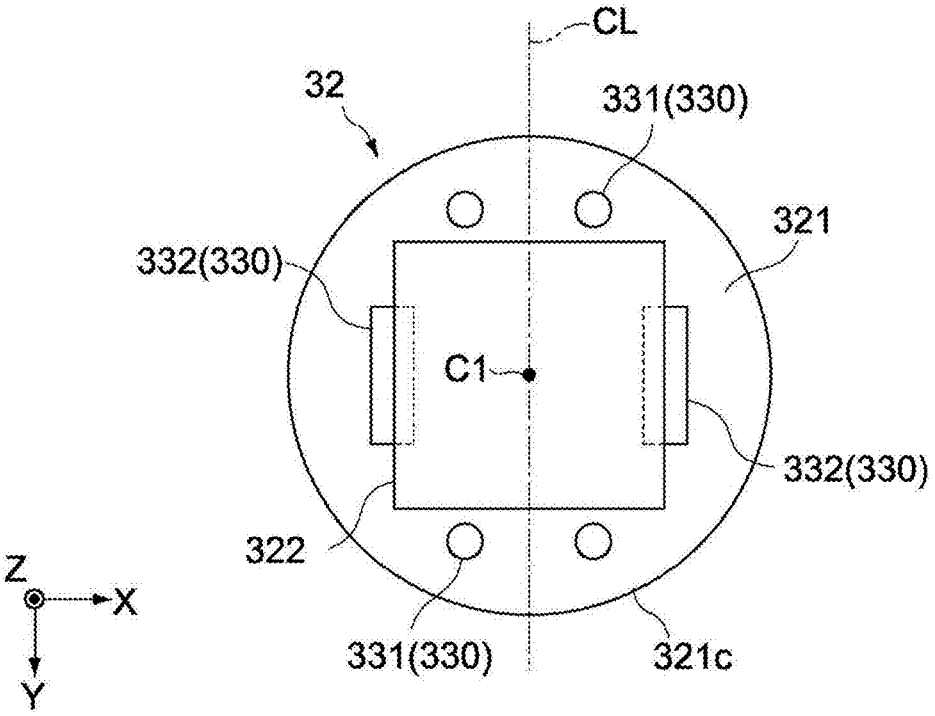
FIG. 3 is a schematic plan view of the piezoelectric speaker in the electroacoustic transducer.

FIG. 3 is a plan view of the piezoelectric speaker 32.

As shown in FIG. 3, the planar shape of the piezoelectric element 322 is a rectangle, and the center axis of the piezoelectric element 322 is typically placed coaxially with the center axis C1 of the vibration plate 321. Instead of being limited by the foregoing, the center axis of the piezoelectric element 322 may be displaced, by a prescribed amount, in the X-axis direction, from the center axis C1 of the vibration plate 321, for example. In other words, the piezoelectric element 322 may be placed at an eccentric position with respect to the vibration plate 321. This way, the vibration center of the vibration plate 321 shifts to a position different from the center axis C1, and therefore the vibration mode of the piezoelectric speaker 32 becomes asymmetrical with respect to the center axis C1 of the vibration plate 321. As a result, the sound pressure properties in the high range can be improved further by, for example, bringing the vibration center of the vibration plate 321 closer to the sound-guiding path 41.

The vibration plate 321 has multiple passage parts 330 in-plane. These passage parts 330 constitute passage parts penetrating through the vibration plate 321 in the thickness direction, and include first opening parts 331 and second opening parts 332. The passage parts 330 interconnect the first space part S1 and the second space part S2 inside the housing 40.

The first opening parts 331 are constituted by multiple circular holes provided in the region between a peripheral part 321*c* of the vibration plate 321 and the piezoelectric element 322. These first opening parts 331 are provided at positions symmetrical with respect to the center axis C1 on the center line CL (line passing through the center of the vibration plate 321 and running parallel with the Y-axis direction), respectively. The first opening parts 331 are formed as round holes, each having the same diameter (a diameter of approx. 1 mm, for example), but it goes without saying that they are not limited by the foregoing.

The second opening parts 332 are each provided between the peripheral part 321*c* and the piezoelectric element 322 and formed as a rectangle having its long sides in the Y-axis direction. The second opening parts 332 are formed along the peripheral part of the piezoelectric element 322 and partially covered by the peripheral part of the piezoelectric element 322. The second opening parts 332 not only function as passages penetrating through the vibration plate 321 from front to back, but, as described below, they also function to prevent short-circuiting between the two external electrodes of the piezoelectric element 322.

Figure 4:
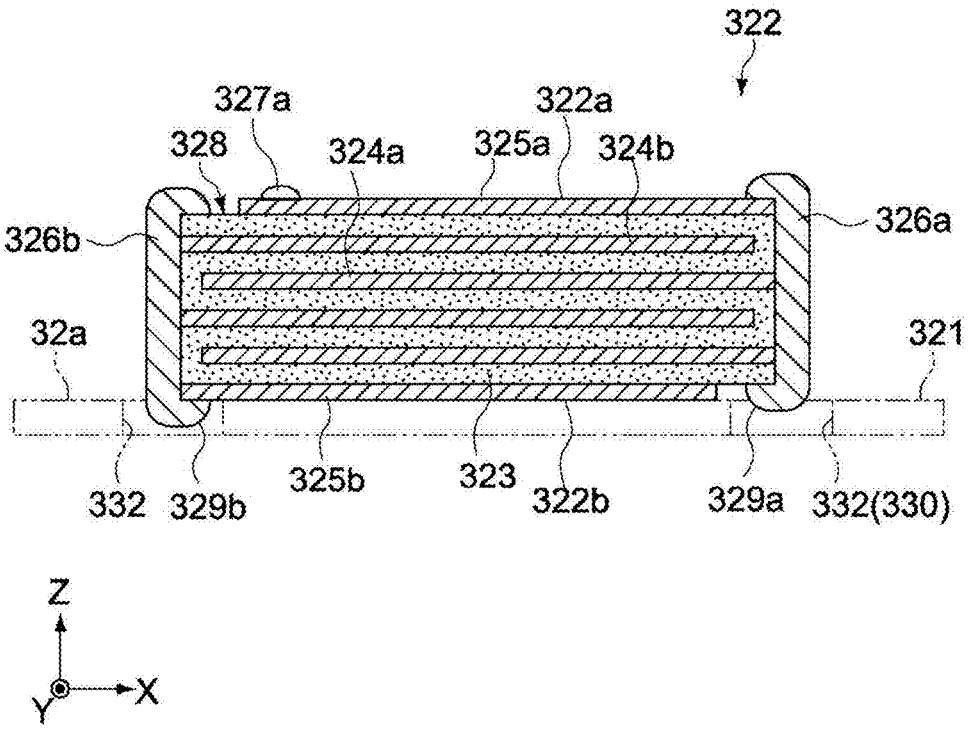
FIG. 4 is a schematic cross-sectional view showing the interior structure of the piezoelectric element in the piezoelectric speaker.

FIG. 4 is a schematic cross-sectional view showing the internal structure of the piezoelectric element 322.

The piezoelectric element 322 has an element body 328 and a first external electrode 326*a* and a second external electrode 326*b* that are facing each other in the XY-axis directions. In addition, the piezoelectric element 322 also has a first principal face 322*a* and a second principal face 322*b* that are facing each other and orthogonal to the Z-axis. The second principal face 322*b* of the piezoelectric element 322 is constituted as a mounting surface facing the first principal face 322*a* of the vibration plate 321.

The element body 328 is structured by ceramic sheets 323 and internal electrode layers 324*a*, 324*b* stacked in the Z-axis direction. To be specific, the internal electrode layers 324*a*, 324*b* are stacked alternately with the ceramic sheets 323 in between. The ceramic sheets 323 are formed by lead zirconate titanate (PZT), alkali metal-containing niobium oxide, or other piezoelectric material, for example. The internal electrode layers 324*a*, 324*b* are formed by a conductive material such as any of various metal materials.

The first internal electrode layers 324*a* of the element body 328 are connected to the first external electrode 326*a*, while being insulated from the second external electrode 326*b* by the margin parts of the ceramic sheets 323. Also, the second internal electrode layers 324*b* of the element body 328 are connected to the second external electrode 326*b*, while being insulated from the first external electrode 326*a* by the margin parts of the ceramic sheets 323.

In FIG. 4, the top layer among the first internal electrode layers 324*a* constitutes a first lead electrode layer 325*a* that partially covers the front face (top face in FIG. 4) of the element body 328, and the bottom layer among the second internal electrode layers 324*b* constitutes a second lead electrode layer 325*b* that partially covers the back face (bottom face in FIG. 4) of the element body 328. The first lead electrode layer 325*a* has a terminal part 327*a* of one polarity connected electrically to the circuit board 33 (FIG. 1), and the second lead electrode layer 325*b* is connected electrically and mechanically to the first principal face 32*a* of the vibration plate 321 via any bonding material as deemed appropriate. If the vibration plate 321 is constituted by a conductive material, the bonding material used may be a conductive adhesive, solder or other conductive bonding material, in which case a terminal part of the other polarity can be provided on the vibration plate 321.

The first and second external electrodes 326*a*, 326*b* are formed roughly at the center part between the two end faces of the element body 328 in the X-axis direction, by a conductive material such as any of various metal materials. The first external electrode 326*a* is electrically connected to the first internal electrode layers 324*a* and the first lead electrode layer 325*a*, and the second external electrode 326*b* is electrically connected to the second internal electrode layers 324*b* and the second lead electrode layer 325*b*.

Such constitution means that, when an alternating-current voltage is applied between the external electrodes 326*a*, 326*b*, each ceramic sheet 323 between each pair of internal electrode layers 324*a*, 324*b* expands/contracts at a prescribed frequency. As a result, the piezoelectric element 322 can generate a vibration which is transmitted to the vibration plate 321. This vibration vibrates the air inside the second space part S2 (FIG. 1), to generate a sound wave in the aforementioned high range (second acoustic sound).

Now, the first and second external electrodes 326*a*, 326*b* project from the two end faces of the element body 328, respectively, as shown in FIG. 4. When this happens, the first and second external electrodes 326*a*, 326*b* may form raised parts 329*a*, 329*b* that project toward the first principal face 32*a* of the vibration plate 321. Accordingly, the aforementioned opening parts 332 are formed large enough to accommodate the raised parts 329*a*, 329*b*. This prevents electrical short-circuiting between the external electrodes 326*a*, 326*b*, which would otherwise be caused by the raised parts 329*a*, 329*b* contacting the vibration plate 321.

(Support Member)

Figure 5:
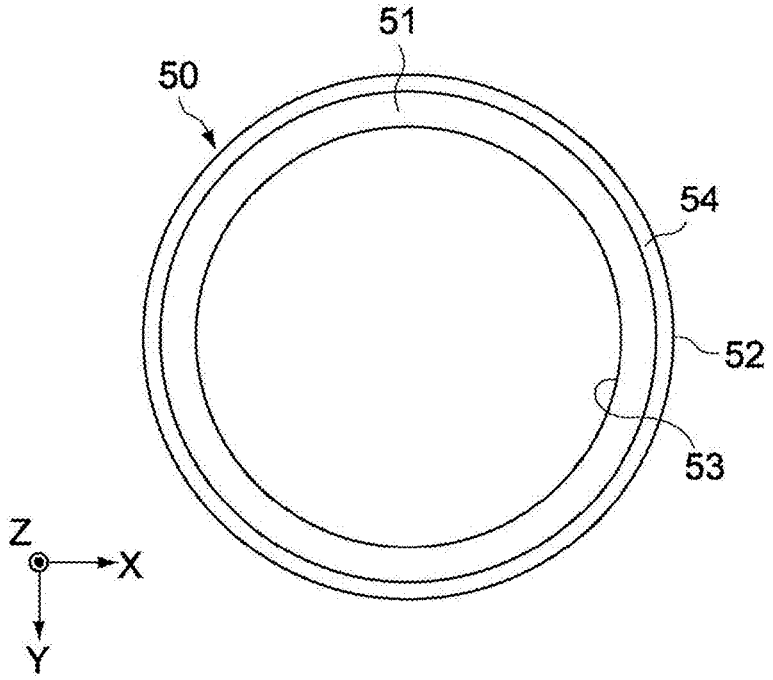
FIG. 5 is a schematic plan view of the support member in the electroacoustic transducer.
Figure 6:
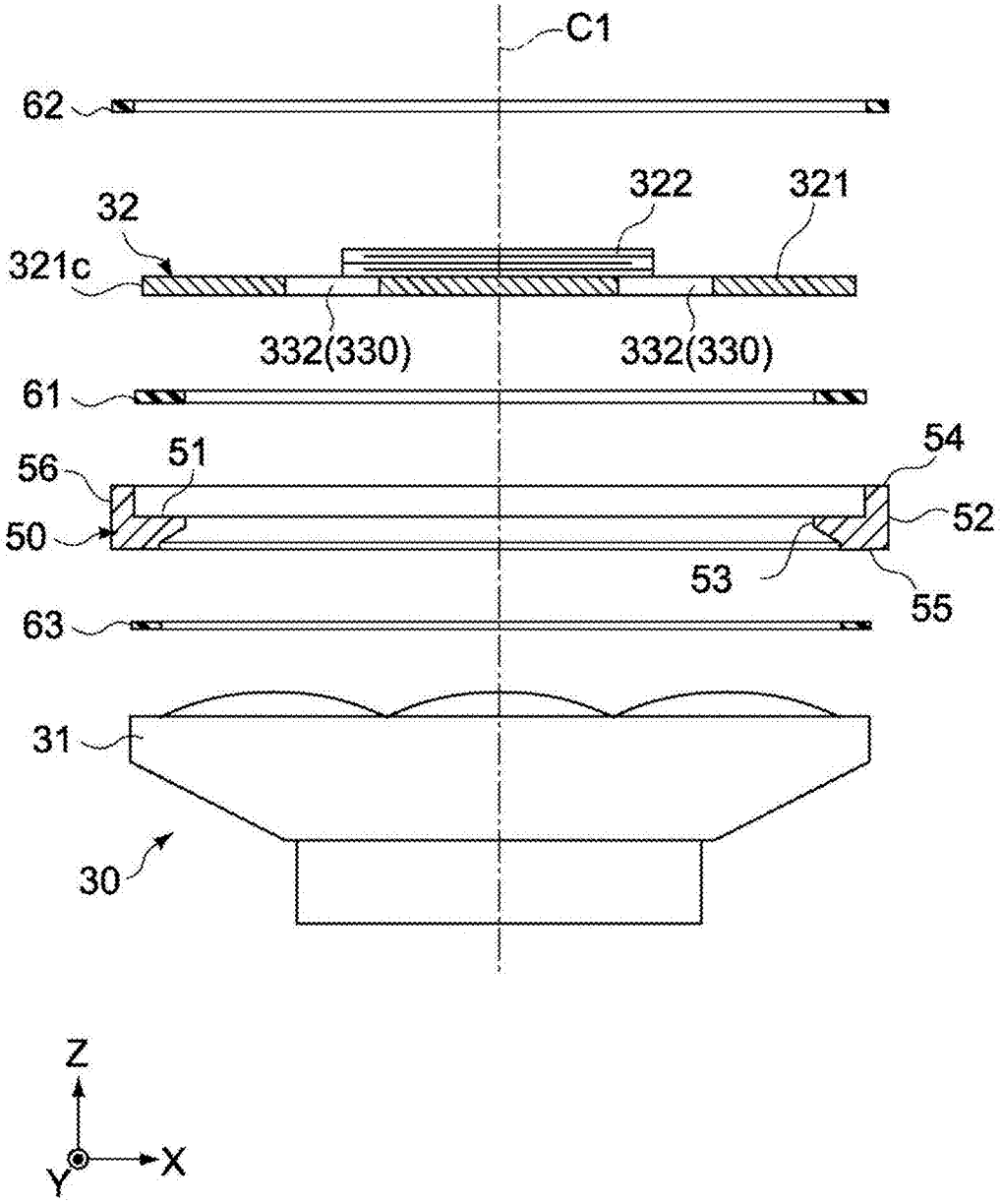
FIG. 6 is an exploded side cross-sectional view of the sounding unit including the support member.

The earphone 100 has a support member 50 (support part) that supports the piezoelectric speaker 32 in a vibratable manner inside the housing 40. FIG. 5 is a schematic plan view of the support member 50, and FIG. 6 is an exploded side cross-sectional view of the sounding unit 30 including the support member 50.

The support member 50 is constituted by a ring-shaped (annular) block body, as shown in FIG. 5. The support member 50 has a support face 51 supporting the peripheral part 321*c* of the vibration plate 321 of the piezoelectric speaker 32, an outer periphery face 52 opposite the interior wall face of the housing 40, an inner periphery face 53 facing the first space part S1, an edge face 54 joined to the housing 40 (second housing part 402), and a bottom face 55 joined to the peripheral part of the dynamic speaker 31.

The support face 51 is joined to the peripheral part 321*c* of the vibration plate 321 via an annular adhesive material layer 61 (first adhesive material layer). As a result, the vibration plate 321 is elastically supported with respect to the support member 50, and this reduces resonance deviation of the vibration plate 321 and ensures stable resonance operation of the vibration plate 321.

Also, the edge face 54 is joined to the inner periphery part on the periphery of the second housing part 402 via an annular adhesive material layer 62 (second adhesive material layer). The bottom face 55 is joined to the dynamic speaker 31 via an annular adhesive material layer 63 (third adhesive material layer). This way, the support member 50 can be elastically sandwiched between the first housing part 401 and the second housing part 402, which allows for stable supporting of the piezoelectric speaker 32 by the support member 50.

The adhesive material layers 61 to 63 are constituted by a material having appropriate elasticity, and typically they are each constituted by a double-sided adhesive tape cut to a prescribed diameter. Besides the above, the adhesive material layers 61 to 63 may also be constituted by a hardened viscoelastic resin, pressure-bonding viscoelastic film, etc. In addition, constituting the adhesive material layers 61 to 63 in annular form increases the airtightness between the dynamic speaker 31 and the support member 50, airtightness between the support member 50 and the vibration plate 321, and airtightness between the support member 50 and the housing 40, respectively, thereby allowing the sound waves generated in the first and second space parts S1, S2 to be guided efficiently to the sound-guiding path 41.

The support member 50 is constituted by a material having a Young's modulus (modulus of longitudinal elasticity) of 3 GPa or higher. Constituted by such material, the support member 50 is ensured to have relatively high rigidity, and thus can stably support the piezoelectric speaker 32 (vibration plate 321) that vibrates in a relatively high frequency range of 7 kHz and higher.

The upper limit of Young's modulus of the material constituting the support member 50 is not limited in any way, but, for example, for materials having a Young's modulus of 5 GPa or higher on their own, which are virtually limited to metals, ceramics and other inorganic materials, the upper limit may be set in any way as deemed appropriate, such as 500 GPa or lower, based on tradeoff analysis of weight, production cost, etc. On the other hand, manufacturing the support member 50 from a synthetic resin material presents advantages in terms of weight reduction and productivity.

Materials having a Young's modulus of 3 GPa or higher include, for example, metal materials, ceramics, synthetic resin materials, and composite materials primarily constituted by synthetic resin materials. Any metal material can be adopted without limitation, such as rolled steel, stainless steel, cast iron or other ferrous material, or aluminum, brass or other nonferrous material. Any ceramic material can be applied as deemed appropriate, such as SiC or $Al_2O_3$.

Synthetic resin materials include polyphenylene sulfide (PPS), polymethyl methacrylate (PMMA), polyacetal (POM), hard vinyl chloride, methyl methacrylate-styrene copolymer (MS), and the like. Also, polycarbonate (PC), styrene-butadiene-acrylonitrile copolymer (ABS), or other resin material that does not have a Young's modulus of 3 GPa or higher on its own can still be adopted if it is provided with a filler (filler material) constituted by glass fiber or other fibrous material or inorganic grains or other fine grains, into a composite material (reinforced plastic) having a Young's modulus (modulus of longitudinal elasticity) of 3 GPa or higher.

The support member 50 may be formed not only as a simple sheet material, but also into a three-dimensional shape whose thickness varies from region to region. This way, the second moment of area can be raised and thus the rigidity (bending rigidity) can be increased further, even though the Young's modulus of the material remains the same.

For example, the support member 50 in this embodiment has a ring-shaped piece 56 (first ring-shaped piece) that projects upward along the outer periphery part of the support face 51 and encloses the peripheral part 321*c* of the vibration plate 321 (refer to FIG. 6), and the aforementioned edge face 54 is formed at its apex. This way, the support member 50 becomes thicker on the outer periphery side than on the inner periphery side, which increases the rigidity against twisting and bending.

[Earphone Operation]

Next, a typical operation of the earphone 100 in this embodiment, as constituted above, is explained.

In the earphone 100 in this embodiment, reproduction signals are input to the circuit board 33 in the sounding unit 30 through the cable 43. Reproduction signals are input, via the circuit board 33, to the dynamic speaker 31 and also to the piezoelectric speaker 32. As a result, the dynamic speaker 31 is driven and primarily low-range sound waves of 7 kHz or lower are generated. At the piezoelectric speaker 32, on the other hand, the vibration plate 321 vibrates due to the expansion/contraction operations of the piezoelectric element 322 and primarily high-range sound waves of 7 kHz or higher are generated. The generated sound waves in each range are transmitted to the user's ear via the sound-guiding path 41. The earphone 100 thus functions as a hybrid speaker having a low-range sounding body and a high-range sounding body.

On the other hand, a sound wave generated by the dynamic speaker 31 is formed as a composite wave composed of a sound wave component propagating to the second space part S2 via the passage parts 330 of the piezoelectric speaker 32, and a sound wave component propagating to the second space part S2 via the passage parts 330. Accordingly, low-range sound waves output from the dynamic speaker 31 can be adjusted or tuned to, for example, frequency properties that allow a sound pressure peak to appear in a prescribed low range by optimizing the size, number, etc. of the passage parts 330.

[Dip]

Figure 7A:
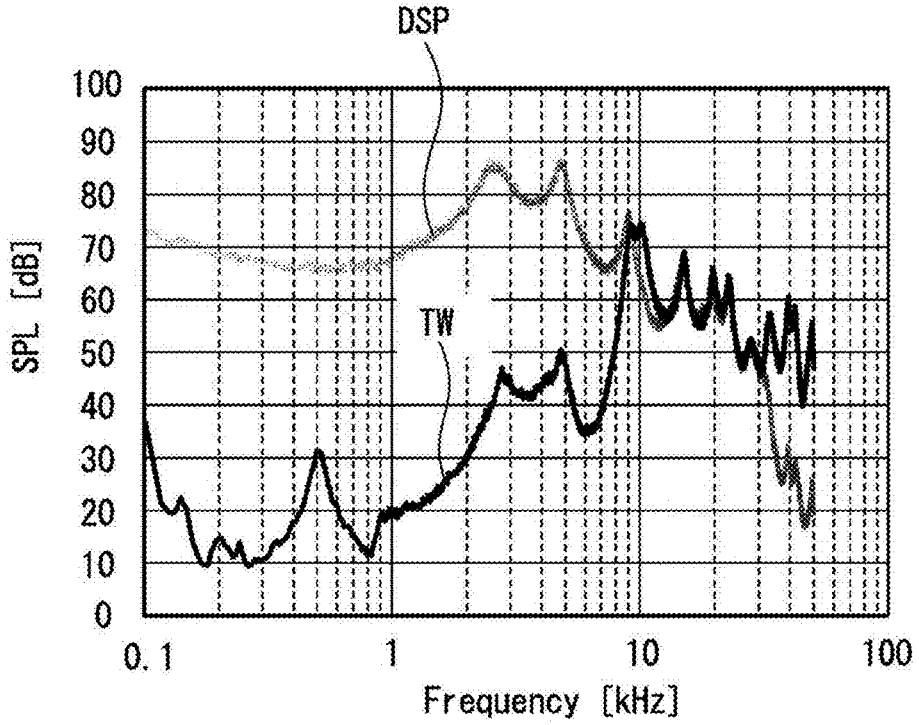
FIG. 7A is a diagram showing an example of sound pressure properties of the dynamic speaker and piezoelectric speaker in the electroacoustic transducer pertaining to a comparative example.
Figure 7B:
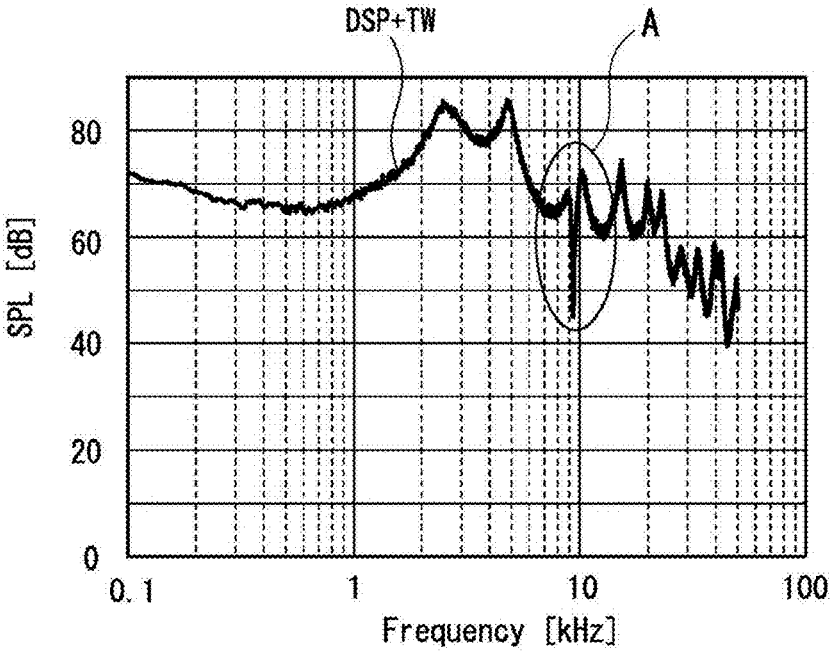
FIG. 7B is a diagram showing an example of sound pressure properties of the electroacoustic transducer in FIG. 7A.

FIG. 7A is a diagram showing an example of sound pressure properties of the dynamic speaker 31 and the piezoelectric speaker 32. FIG. 7B is a diagram showing an example of sound pressure properties of an earphone.

As shown in FIGS. 7A and 7B, a reproduced sound from the earphone is a composite sound composed of a reproduced sound S (DSP) from the dynamic speaker 31 (first acoustic sound) and a reproduced sound S (TW) from the piezoelectric speaker 32 (second acoustic sound). As shown in FIG. 7A, the reproduced sound S (DSP) from the dynamic speaker 31 is dominant in a frequency range of 9 kHz and lower, while the reproduced sound S (TW) from the piezoelectric speaker 32 is dominant in a frequency range of 9 kHz or higher, in the reproduced sound from the earphone.

Depending on the frequency properties of the dynamic speaker 31 and the piezoelectric speaker 32, however, a sudden drop (dip) in the sound pressure level of the composite sound composed of these reproduced sounds S (DSP), S (TW) may occur near a crossover frequency (approx. 9 kHz) at which the sound pressure P (DSP) of the reproduced sound S (DSP) form the dynamic speaker 31 (first sound pressure) intersects the sound pressure P (TW) of the reproduced sound S (TW) from the piezoelectric speaker 32 (second sound pressure), as indicated by symbol A in FIG. 7B. This is probably because, depending on the acoustic properties of the reproduced sounds S (DSP), S (TW), the phases of the reproduced sounds S (DSP), S (TW) cancel each other out near the crossover frequency.

The inventors of the present invention found that the problem of a dip occurring near a crossover frequency can be resolved by properly adjusting the phases of the two reproduced sounds S (DSP), S (TW).

In general, the sound pressure level of a pressure wave P is described as $SPL=20\log(p/p_0)$.

Figure 8:
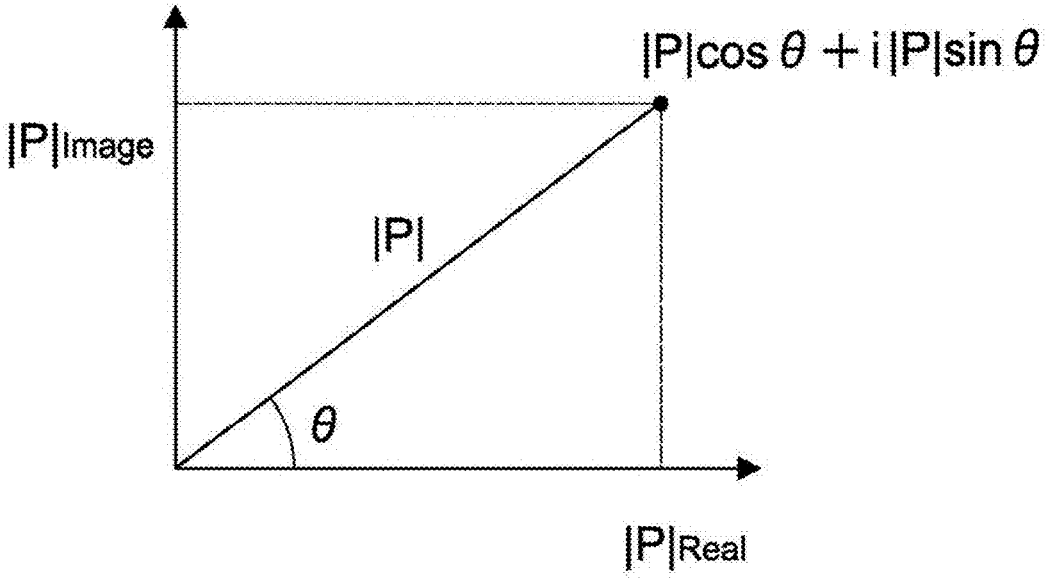
FIG. 8 is a diagram explaining a complex representation of pressure waves.

A complex representation of the pressure wave P is $P=|P|\cos\theta+i|P|\sin\theta$. As shown in FIG. 8, the following holds:

$$|P|_{Real}=|P|\cos\theta,$$

$$|P|_{Image}=|P|\sin\theta$$

Accordingly, the real-axis component $|P\ (DSP)|_{Real}$ and imaginary-axis component $|P\ (DSP)|_{Image}$ of the sound pressure of the reproduced sound S (DSP), and the real-axis component $|P\ (TW)|_{Real}$ and imaginary-axis component $|P\ (TW)|_{Image}$ of the sound pressure of the reproduced sound S (TW), are described as follows, respectively:

$$|P(DSP)|_{Real}=|P(DSP)|\cos\theta_1,$$

$$|P(TW)|_{Real}=|P(TW)|\cos\theta_2,$$

$$|P(DSP)|_{Image}=|P(DSP)|\sin\theta_1,$$

$$|P(TW)|_{Image}=|P(TW)|\sin\theta_2$$

Here, θ1 indicates the phase of the reproduced sound S (DSP), while $\theta_2$ indicates the phase of the reproduced sound S (TW).

In a crossover frequency range (near a crossover frequency), $|P(DSP)|\cong|P(TW)|$ is considered true; accordingly, a sound pressure in the crossover frequency range can be described as follows:

$$|P(DSP+TW)|\cong|P(DSP|\{(\cos\theta_1+\cos\theta_2)^2+(\sin\theta_1+\sin\theta_2)^2\}^{1/2}$$

Now, it can be assumed that the coupling of the reproduced sounds S (DSP), S (TW) is affected by their respective phases and that the value of the square root term on the right side of the above expression is an index indicating the degree of coupling. So, when this term is defined as α, the expression is rephrased as follows:

$$\alpha\equiv\{(\cos\theta_1+\cos\theta_2)^2+(\sin\theta_1+\sin\theta_2)^2\}^{1/2}$$

α takes the maximum value of 2 when $\theta_1=\theta 2$, or specifically when the reproduced sound S (DSP) from the dynamic speaker 31 has a zero phase difference with the reproduced sound S (TW) from the piezoelectric speaker 32, and when $\theta_1=\theta_2+\pi$, the two reproduced sounds S (DSP), S (TW) cancel each other out and α becomes 0.

In other words, α takes a continuous value of 0 to 2.

[Electroacoustic Transducer in this Embodiment]

The earphone 100 in this embodiment is constituted so that index α is 0.5 or greater. In other words, the constitution of this embodiment is such that the sum P (DSP+TW) of the sound pressure P (DSP) of the reproduced sound S (DSP) from the dynamic speaker 31 and the sound pressure P (TW) of the reproduced sound S (TW) from the piezoelectric speaker 32, in a crossover frequency range, becomes equal to or greater than 0.5 times the sound pressure P (DSP) of the dynamic speaker 31 in the crossover frequency range. This way, occurrence of dip near a crossover frequency can be reduced and acoustic properties can be improved.

A crossover frequency range of a sound pressure P (DSP) and a sound pressure P (TW) refers to a prescribed frequency range that includes a crossover frequency (approx. 9 kHz), such as a range of 8 to 10 kHz. By adjusting a composite sound pressure (P (DSP+TW)) in this range to a level equal to or greater than 0.5 times, or preferably a level equal to or greater than one time, the sound pressure P (DSP), occurrence of dip near the crossover frequency can be efficiently prevented.

In particular, occurrence of dip near a crossover frequency tends to become more prominent as the diameter of the vibration plate 321 of the piezoelectric speaker 32 decreases (to a diameter of 10 mm or less, for example); by properly setting index α as described above, however, the reproduced sound S (DSP) from the dynamic speaker 31 couples with the reproduced sound S (TW) from the piezoelectric speaker 32 in a favorable manner near a crossover frequency, and therefore good, dip-free acoustic properties can be ensured.

The method for setting index α is not limited in any way, and by adjusting the acoustic properties of at least one of the dynamic speaker 31 and the piezoelectric speaker 32, index α can be set to a desired value. For example, lowering the resonance frequency of the piezoelectric speaker 32 by decreasing the thickness, or lowering the rigidity, of the vibration plate 321, facilitates the setting of index α.

In addition to the above, adjusting the thickness or viscoelasticity of the adhesive material layer 61 (FIG. 1) supporting the peripheral part of the vibration plate 321, or offsetting the center of the piezoelectric element 322 relative to the center axis C1 of the vibration plate 321 to adjust the vibration properties of the vibration plate 321, also benefits the setting of index α. Additionally, the material (Young's modulus), rigidity, etc., of the support member 50 may also be adjusted.

Application Example 1

Figure 9A:
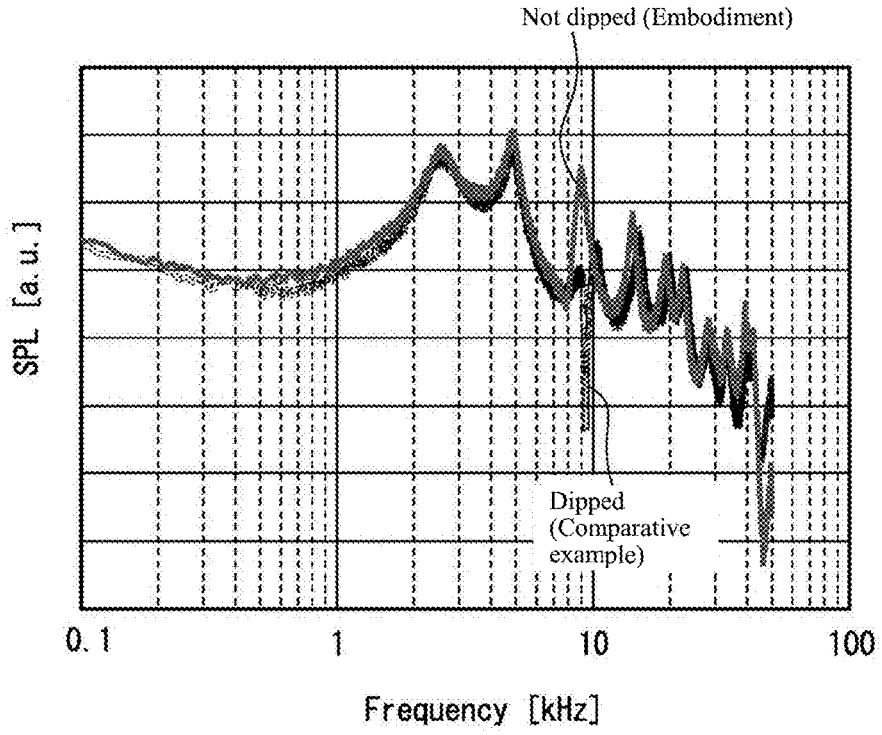
FIG. 9A is a diagram explaining Application Example 1, presenting an experimental result of comparing the acoustic properties of two electroacoustic transducers having different indexes α.
Figure 9B:
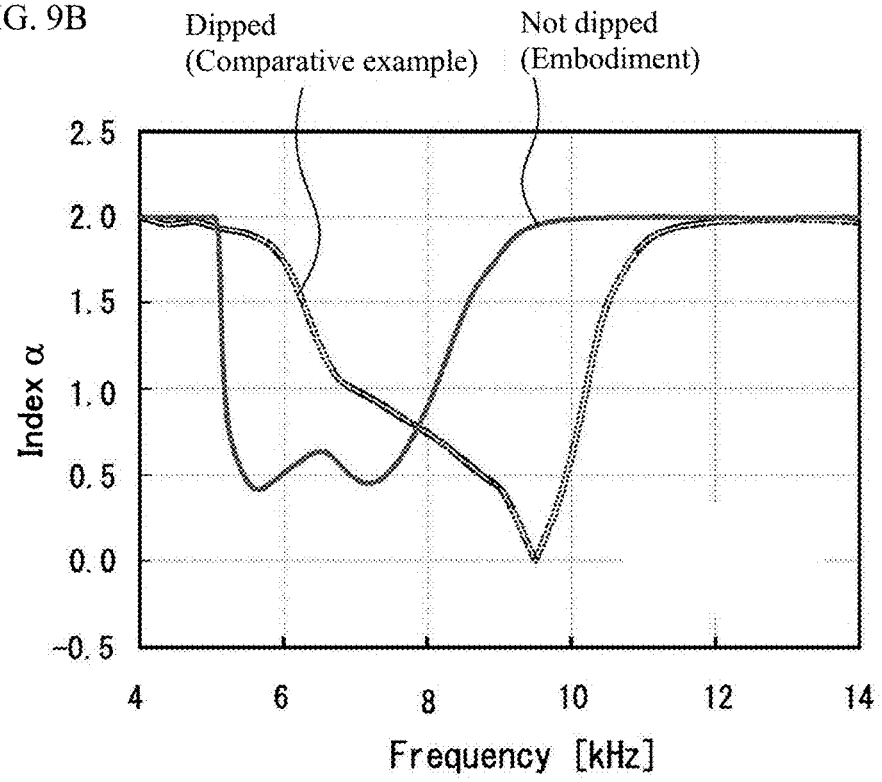
FIG. 9B is a diagram explaining Application Example 1, showing the frequency properties of index α in the comparative example and those in the embodiment.

FIG. 9A presents an experimental result of comparing the acoustic properties of two earphones of different indexes α. FIG. 9B shows the frequency properties of index α in a comparative example and index α in this embodiment. In FIGS. 9A and 9B, "Dipped" corresponds to the acoustic properties of the earphone pertaining to the comparative example as shown in FIG. 7A, and "Not dipped" corresponds to the acoustic properties of the earphone 100 pertaining to this embodiment. The diameter of the vibration plate 321 of the piezoelectric speaker 32 was 12 mm in both cases, while the resonance frequency was 9.9 kHz in the comparative example (Dipped) and 9.2 kHz in this embodiment (Not dipped).

As shown in FIGS. 9A and 9B, the earphone in the comparative example has an index α of 1 or smaller in the crossover frequency range (8 to 10 kHz) of the reproduced sound S (DSP) from the dynamic speaker 31 and the reproduced sound S (TW) from the piezoelectric speaker 32, and particularly near the crossover frequency (approx. 9.5 kHz), index α is 0.5 or smaller. According to this embodiment, on the other hand, index α in the crossover frequency range is 0.5 or greater, and particularly near the crossover frequency, index α is 1 or greater (but no greater than 2). This confirms that, according to this embodiment, a sudden drop in sound pressure, or dip, near a crossover frequency would be effectively reduced, and particularly in this example, the sound pressures near the crossover frequency improved.

Application Example 2

Figure 10A:
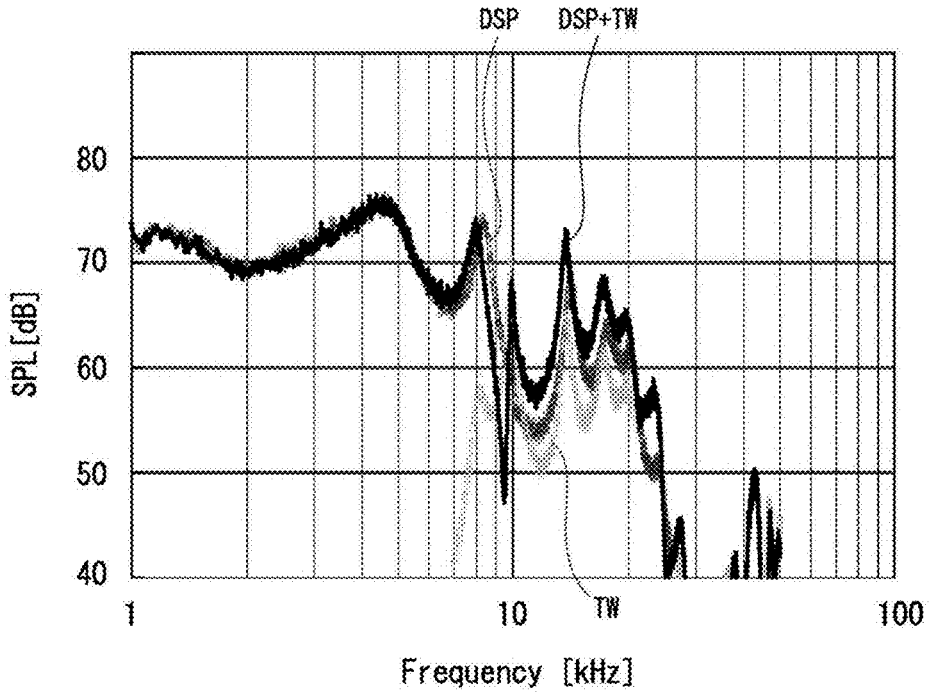
FIG. 10A is a diagram explaining Application Example 2, presenting an experimental result showing the acoustic properties of the electroacoustic transducer pertaining to the comparative example.
Figure 10B:
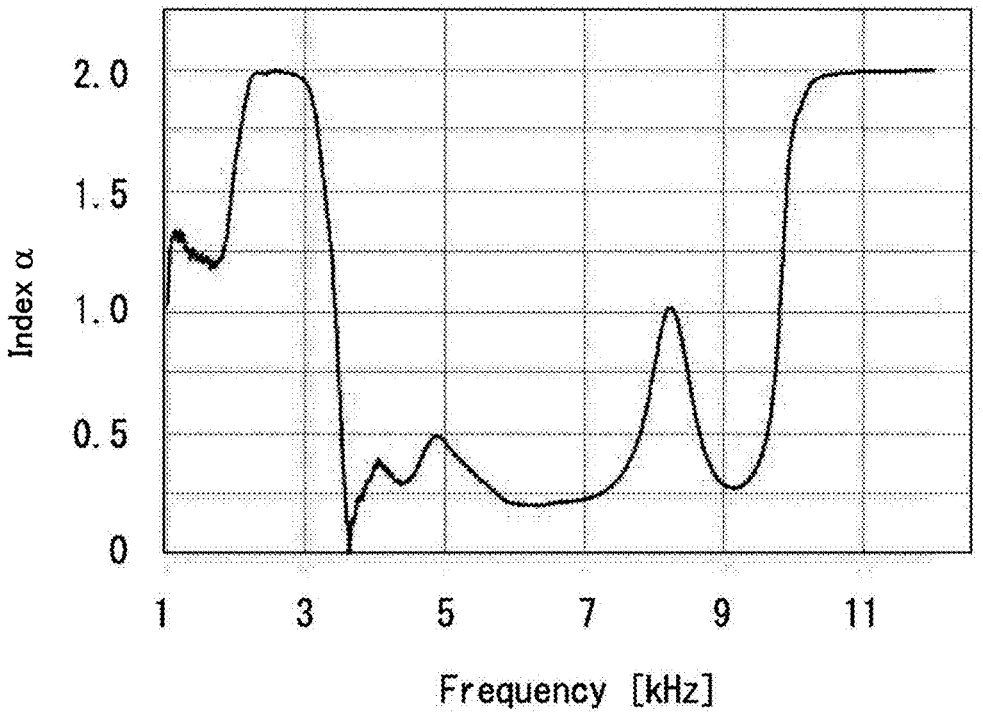
FIG. 10B is a diagram showing the frequency properties of index α in the comparative example in FIG. 10A.

FIG. 10A presents an experimental result showing the acoustic properties of the earphone pertaining to the comparative example, whose index α frequency properties are shown in FIG. 10B.

Figure 11A:
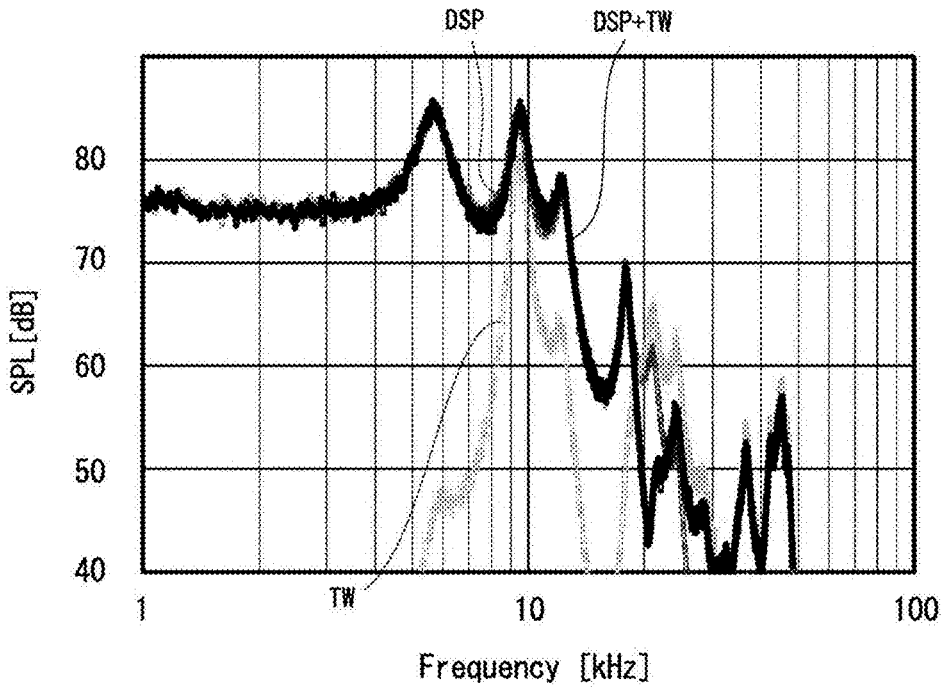
FIG. 11A is a diagram explaining Application Example 2, presenting an experimental result showing the acoustic properties of the electroacoustic transducer pertaining to the embodiment.
Figure 11B:
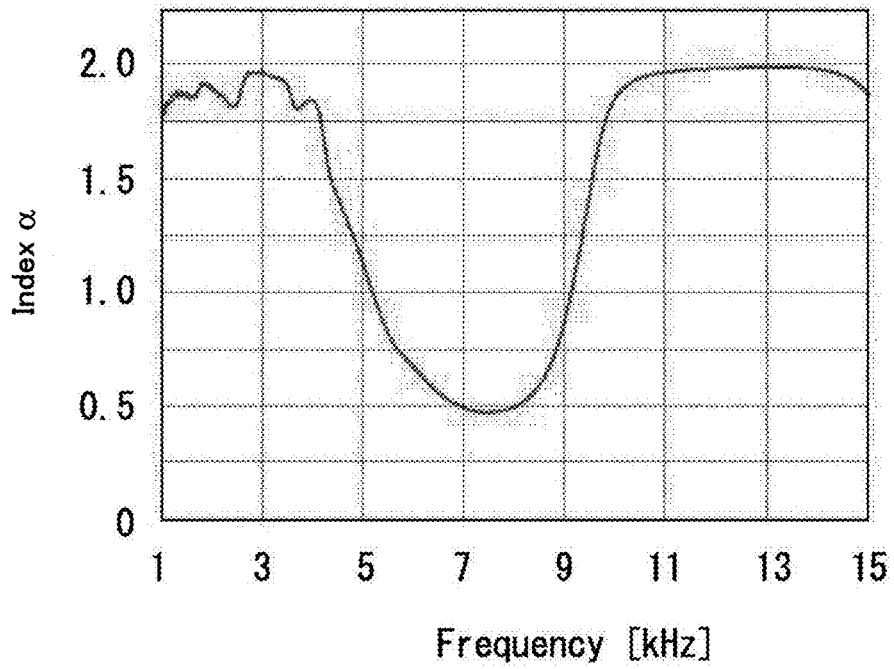
FIG. 11B is a diagram showing the frequency properties of index α in the embodiment in FIG. 11A.

On the other hand, FIG. 11A presents an experimental result showing the acoustic properties of the earphone pertaining to this embodiment, whose index α frequency properties are shown in FIG. 11B.

In this example, the diameter of the vibration plate 321 of the piezoelectric speaker 32 was 8 mm in both cases, while the resonance frequency was 9.8 kHz in the comparative example (FIGS. 10A and 10B) and 9.3 kHz in this embodiment (FIGS. 11A and 11B).

The earphone pertaining to the comparative example exhibited a significant drop in index α over a wide range of 3 kHz to 10 kHz, and index α assumed an extremely low value of 0.25 near the crossover frequency (approx. 9.5 kHz), as shown in FIG. 10B. As a result, the sound pressure level of the composite sound from the dynamic speaker and the piezoelectric speaker dropped suddenly (dipped) in the crossover frequency range including the crossover frequency (refer to FIG. 10A).

With the earphone 100 pertaining to this embodiment, on the other hand, there was a region where index α dropped, but the frequency range in which index α dropped shifted toward a lower frequency range (3 kHz to 8 kHz) from near the crossover frequency, as shown in FIG. 11B. Moreover, index α reached the maximum value (α=2) near the crossover frequency, which not only eliminated a dip, but also caused the sound pressure level to rise significantly (refer to FIG. 11A).

As described above, in this embodiment the concept of index α indicating the degree of coupling of the two reproduced sounds S (DSP), S (TW) in the crossover frequency range is introduced, and the vibration properties of the piezoelectric speaker 32 are adjusted so that the value of this index α becomes 0.5 or greater, or preferably 1 or greater. As a result, occurrence of sudden drop (dip) in the sound pressure level of the earphone 100 near the crossover frequency is reduced, and the acoustic properties can be improved.

Also, according to this embodiment, the resonance frequency is optimized without lowering the sharpness of resonance (Q) of the piezoelectric speaker 32; accordingly, occurrence of dip can be reduced without lowering the sound pressure level near the crossover frequency.

The foregoing explained an embodiment of the present invention; however, it goes without saying that the present invention is not limited to the aforementioned embodiment and various modifications can be added.

For example, the above embodiment explained application examples where the vibration plate 321 of the piezoelectric speaker 32 had a diameter of 12 mm or 8 mm; however, the present invention can also be applied, in the same manner, to piezoelectric sounding bodies having a vibration plate with a diameter of 10 mm or less than 8 mm.

In addition, while the above embodiment explained an example where the electroacoustic transducer was an earphone, the present invention is not limited to this and it can also be applied to headphones, stationary speakers, built-in speakers of mobile information terminals, etc.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2017-145207, filed Jul. 27, 2017, the disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. An electroacoustic transducer comprising:

a dynamic speaker that generates a first acoustic sound; and a piezoelectric speaker that generates a second acoustic sound;

wherein a sum of sound pressures of the first and second acoustic sounds in a crossover frequency range of a sound pressure of the first acoustic sound and a sound pressure of the second acoustic sound, is equal to or greater than 0.5 times the sound pressure of the first acoustic sound in the crossover frequency range.

2. The electroacoustic transducer according to claim 1, wherein the sum of sound pressures of the first and second acoustic sounds in the crossover frequency range is equal to or greater than one times the sound pressure of the first acoustic sound in the crossover frequency range.

3. The electroacoustic transducer according to claim 1, wherein:

the piezoelectric speaker has a circular vibration plate; and a diameter of the vibration plate is 10 mm or less.

4. The electroacoustic transducer according to claim 2, wherein:

the piezoelectric speaker has a circular vibration plate; and a diameter of the vibration plate is 10 mm or less.

5. An electroacoustic transducer comprising:

a dynamic speaker that generates a first acoustic sound; and a piezoelectric speaker that generates a second acoustic sound;

wherein a reproduced sound of the first acoustic sound and a reproduced sound of the second acoustic sound have a crossover frequency range, and the reproduced sound of the first acoustic sound has a phase ($\theta_1$) and the reproduced sound of the second acoustic sound has a phase ($\theta_2$) in the crossover frequency range, the phase ($\theta_1$) and the phase ($\theta_2$) being such that index $\alpha$ is 0.5 or greater where $$\alpha=\{(\cos\theta_1+\cos\theta_2)^2+(\sin\theta_1+\sin\theta_2)^2\}^{1/2}$$

wherein $\alpha=2$ when $\theta_1=\theta_2$, and $\alpha=0$ when $\theta_1=\theta_2+\pi$.

6. The electroacoustic transducer according to claim 5, wherein the crossover frequency is 8 kHz to 10 kHz.

7. The electroacoustic transducer according to claim 5, wherein the piezoelectric speaker has a circular vibration plate having a diameter of 10 mm or less.

8. The electroacoustic transducer according to claim 5, wherein the piezoelectric speaker has a resonance frequency adjusted in a manner satisfying $0.5\leq\alpha$.

9. A method of tuning acoustic properties of an electroacoustic transducer comprising: a dynamic speaker that generates a first acoustic sound; and a piezoelectric speaker that generates a second acoustic sound, wherein a reproduced sound of the first acoustic sound and a reproduced sound of the second acoustic sound have a crossover frequency range, said method comprising:

(i) determining a phase ($\theta_1$) of the reproduced sound of the first acoustic sound and a phase ($\theta_2$) of the reproduced sound of the second acoustic sound in the crossover frequency range, and (ii) adjusting a configuration of the dynamic speaker and/or a configuration of the piezoelectric speaker in a manner satisfying index $\alpha$ is 0.5 or greater where $$\alpha=\{(\cos\theta_1+\cos\theta_2)^2+(\sin\theta_1+\sin\theta_2)^2\}^{1/2}$$

wherein $\alpha=2$ when $\theta_1=\theta_2$, and $\alpha=0$ when $\theta_1=\theta_2+\pi$.

10. The method to claim 9, wherein the crossover frequency is 8 kHz to 10 kHz.

11. The method according to claim 9, wherein the piezoelectric speaker has a circular vibration plate having a diameter of 10 mm or less.

12. The method according to claim 9, wherein step (ii) comprises lowering a resonance frequency of the piezoelectric speaker by decreasing a thickness, or lowering the rigidity, of a vibration plate of the piezoelectric speaker.

13. The method according to claim 9, wherein step (ii) comprises adjusting a thickness or viscoelasticity of an adhesive material layer supporting a peripheral part of a vibration plate of the piezoelectric speaker, and/or offsetting a center of a piezoelectric element relative to a center axis of the vibration plate to adjust vibration properties of the vibration plate.

* * * * *